United States Patent [19]

Arzoumanian et al.

[11] 4,422,784

[45] Dec. 27, 1983

[54] SOLENOID-TYPE HAMMER ASSEMBLY FOR IMPACT PRINTER

[75] Inventors: Aram S. Arzoumanian, Encino; Heinz W. Hieber, Valencia; Howard H. Nojiri, Agoura; Jimmie L. Hart, South Lake Tahoe, all of Calif.

[73] Assignee: Dataproducts Corporation, Woodland Hills, Calif.

[21] Appl. No.: 366,524

[22] Filed: Apr. 8, 1982

[51] Int. Cl.[3] ..... B41J 9/133

[52] U.S. Cl. ..... 400/144.2; 101/93.48; 400/157.2

[58] Field of Search ..... 101/93.02, 93.48; 335/257, 263, 261, 262; 400/124, 144.2, 144.3, 157.2

[56] References Cited

U.S. PATENT DOCUMENTS

| | | | |
|---|---|---|---|
| 2,331,942 | 10/1943 | Turnbull et al. | 335/263 X |
| 2,383,411 | 8/1945 | Obszarny | 335/261 |
| 2,407,963 | 9/1946 | Persons | 335/261 |
| 2,698,159 | 12/1954 | Crum | 335/262 X |
| 2,923,520 | 2/1960 | Ray | 335/257 X |
| 4,016,965 | 4/1977 | Wirth et al. | 400/124 |
| 4,236,842 | 12/1980 | Dick et al. | 400/144.2 |
| 4,239,401 | 12/1980 | Veale | 400/144.2 |
| 4,272,747 | 6/1981 | Bauer | 335/257 |
| 4,308,794 | 1/1982 | Adamoli et al. | 400/157.2 X |

FOREIGN PATENT DOCUMENTS

| | | | |
|---|---|---|---|
| 2158263 | 5/1972 | Fed. Rep. of Germany | 400/144.2 |
| 2853301 | 7/1980 | Fed. Rep. of Germany | 335/257 |
| 142316 | 6/1980 | German Democratic Rep. | 400/157.2 |

OTHER PUBLICATIONS

*IBM Tech. Disc. Bulletin,* by R. Mathews, vol. 22, No. 4, Sep. 1979, pp. 1318–1319.

*IBM Tech. Disc. Bulletin,* by J. McGuire, vol. 19, No. 6, Nov. 1976, p. 2036.

*IBM Tech. Disc. Bulletin,* by R. Kulterman, vol. 21, No. 1, Jun. 1978, p. 15.

*IBM Tech. Disc. Bulletin,* by T. Kauno, vol. 21, No. 10, Mar. 1979, p. 4096.

*Primary Examiner*—Paul T. Sewell

*Attorney, Agent, or Firm*—Spensley, Horn, Jubas & Lubitz

[57] ABSTRACT

There is disclosed a hammer assembly for a high speed impact printer of the type comprising a solenoid including a coil and an axially-apertured pole piece, the pole piece having a conically-shaped recessed surface, an axially movable armature within the solenoid, the armature having a tapered conical leading surface facing and substantially parallel to the recessed surface of the pole piece, and a hammer, one end of the hammer being rigidly connected to the armature to form a unitized armature/hammer element for striking a print element in the printer, the hammer extending through the aperture in the pole piece. The present hammer assembly achieves, when compared to previous designs, a longer stroke, an increase in impact energy, a reduction of rebound and settling time, an increase in hammer life expectancy, a decrease in cost, improved reliability and a reduction in weight.

3 Claims, 2 Drawing Figures

FIG. 1.
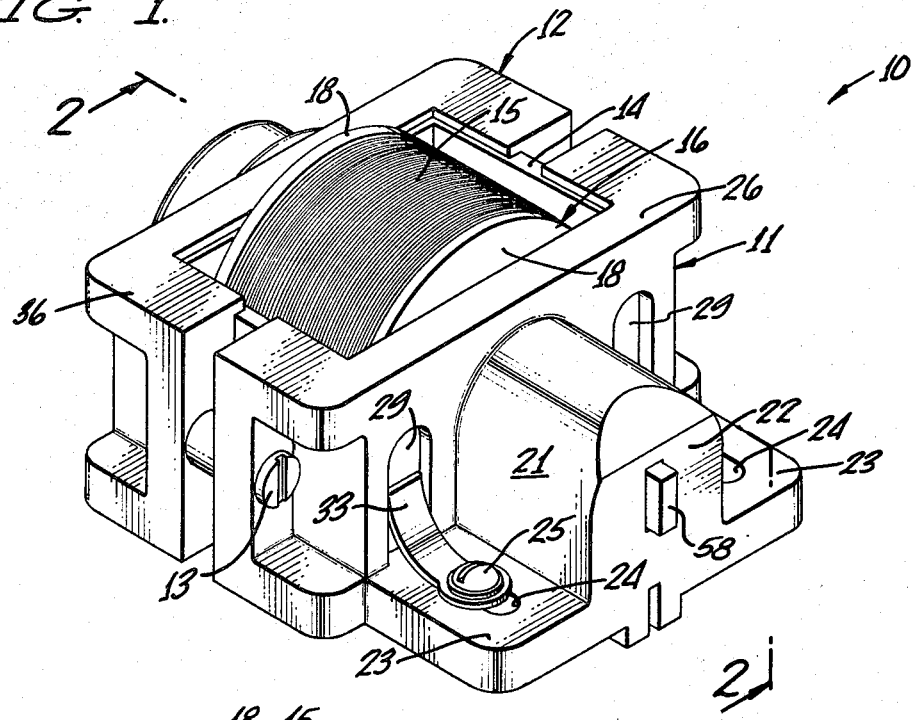
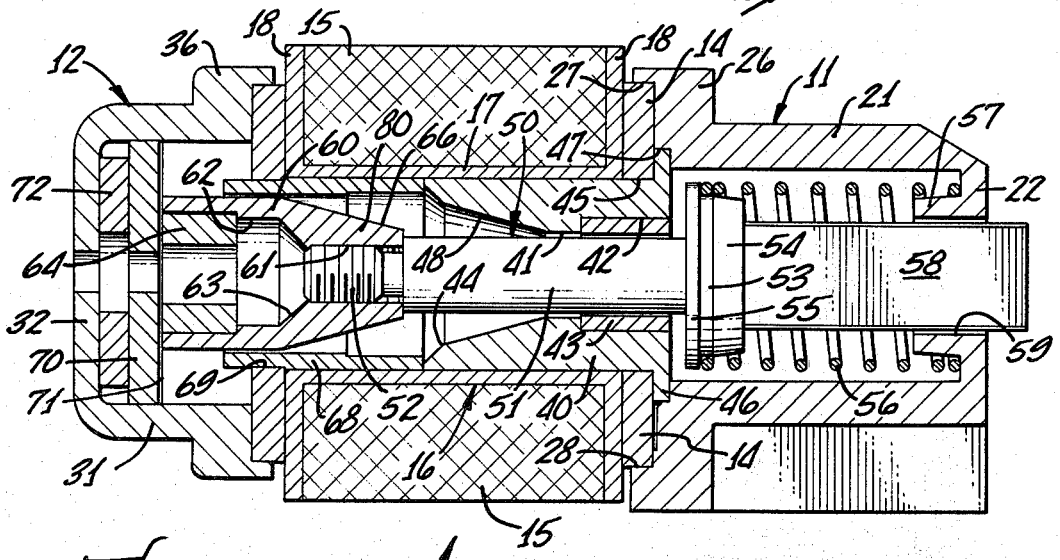
FIG. 2.

SOLENOID-TYPE HAMMER ASSEMBLY FOR IMPACT PRINTER

BACKGROUND OF THE INVENTION

1. Field of the Invention

The present invention relates to a solenoid-type hammer assembly for an impact printer and, more particularly, to an improved design of an electromagnetically actuated hammer mechanism of the type used to strike the printing element in an impact printer.

2. Description of the Prior Art

The advent of high speed data processing and word processing equipment has brought about a need for high speed printers capable of producing high quality printing. Perhaps the most popular type of printer in such applications is that which uses the so-called "daisy wheel". The daisy wheel basically consists of a disc having a plurality of flexible fingers or petals around its periphery, each of which bears a particular print character. In operation, a daisy wheel is rotated until the selected character is in position for printing, at which time a hammer means drives the print element against the paper to be printed. A typical example of such a printer is disclosed in U.S. Pat. No. 3,954,163 to Gabor.

In such printers, it is necessary to have a significant clearance space between the hammer and the print wheel or daisy wheel when the hammer is withdrawn so that the print wheel may rotate freely without danger of striking the hammer and damaging the relatively fragile spokes or petals of the daisy wheel. Accordingly, the hammer must have a relatively long stroke so that it can be withdrawn a significant distance away from the print wheel as the print wheel rotates, while being capable of driving the printing element against the paper to be printed when the print wheel has stopped. The obvious approach to achieving such a long hammer stroke would be to propel the hammer by a strong magnetic field produced by a relatively large solenoid. However, in such printers, in order to achieve high speed, it is desirable to keep the hammer assembly as light in weight as possible, thereby effectively precluding the use of a large, heavy solenoid.

In order to make use of relatively small, lightweight electromagnetic coils, the initial prior art daisy wheel printers used the coils to drive a relatively long clapper arm, much like that used in an electric doorbell. The end of the clapper arm traveled in a relatively wide arch to strike the hammer, thereby allowing the hammer to have the necessary long stroke while using coils which are relatively small and lightweight. Such a hammer assembly soon proved to be undesirable, primarily because the driving of the hammer indirectly through a second drive element, i.e. the clapper, limits the ability to control the impact force of the hammer against the print element.

In order to overcome these objections, an entirely new type of hammer assembly was developed, one with a specially designed pole piece and armature. This type of hammer assembly is disclosed in U.S. Pat. No. 4,239,401 to Veale. In the hammer assembly of Veale, the armature is formed with a tapered leading surface which is essentially in the shape of a truncated right frusticone. The pole piece is formed with a recess which conforms to the shape of the armature's leading surface. This configuration of the armature and pole piece provides for a magnetic force field having essentially parallel lines of force between the armature and the pole piece so that the magnetic force between the armature and pole piece is substantially constant as the armature moves toward the pole piece. The advantages of such a force field are two fold: (1) the force on the armature being constant, regardless of the distance from the pole piece, the acceleration of the armature is constant; and (2) since the lines of force do not diverge as the distance from the pole piece increases, the initial position of the armature can be a significant distance from the pole piece and still be within an area of substantial magnetic field strength, thereby allowing the armature to be propelled toward the pole piece for a relatively long distance. This configuration thus allows the armature to be made unitary with the hammer so that the hammer can travel with the necessary length of stroke without the need of a clapper. Not only is the mechanism of the Veale hammer assembly greatly simplified over that of the prior art hammer/clapper assembly, but elimination of the limitations inherent in the use of the clapper allow a capability of much higher printing speed while providing for greater control of the hammer's actions.

The hammer assembly of the Veale patent is provided with a polyurethane cushion against which the armature strikes after the hammer rebounds from the impact against the printing element. This cushion absorbs a significant part of the momentum of the armature/hammer element, thereby attempting to bring the armature/hammer element to a complete stop almost immediately after impact against the printing element.

While the Veale-type hammer assembly represents a considerable improvement over the hammer/clapper type of hammer assembly, significant problems were encountered in use. That is, the Veale hammer assembly was found to have an insufficient stroke which would lead to the ram striking out by bottoming out in the pole piece. An increased stroke is required when the daisy wheel breaks and the hammer must reach the platen before the ram bottoms out. It was also found that the polyurethane cushion alone did not absorb substantially all of the momentum of the armature/hammer element so that there has been excessive hammer settling time which limits the printer speed. Along the same lines, there was found to be excessive hammer rebound from the cushion which could cause the hammer to strike the rotating wheel, damaging the hammer and the wheel. Also encountered was an inconsistency in impact energy due to random friction and a relatively short life expectancy because of wear of moving parts.

In the Veale hammer assembly, spring tangs at the end of a spring positioned in tang holes were used to prevent rotation of the hammer assembly. However, it has been found that this is ineffectual in preventing hammer rotation over a long period of time, the result being that the hammer rotates and strikes two adjacent print elements.

Another area of significant concern is that the hammer assembly of Veale is manufactured in an expensive manner, because of the large number of parts, resulting in a product having an excessive cost and an inadequate life expectancy. Problems were also encountered in assembling and aligning the multiple parts.

SUMMARY OF THE INVENTION

According to the present invention, there is provided an improved solenoid-type hammer assembly of the general type described in the aforementioned Veale patent. On the other hand, the present invention improves on the Veale design in several significant respects. The present invention incorporates a number of improvements which achieve a significantly longer hammer stroke. This prevents the ram from bottoming out in the pole piece under circumstances where the daisy wheel breaks and the hammer must reach the platen before bottoming. With the present design, the hammer settling time is substantially reduced so as to substantially increase the printing speed. Furthermore, the present design prevents the hammer from rebounding by a distance which will cause the hammer to strike the rotating daisy wheel.

The present design results in a consistent impact energy and a significantly increased life expectancy because of the reduction of wear of moving parts. With the present design, rotation of the hammer is prevented thereby insuring that the hammer will not strike more than one print element. The present design is substantially simplified, making it much less expensive and also much lighter. The simplification also results in substantially reduced assembly time because of significantly fewer parts.

The present invention represents an improvement in a hammer assembly for a high speed impact printer of the type comprising a solenoid including a coil and an axially-apertured pole piece, the pole piece having a conically-shaped recessed surface, an axially movable armature within the solenoid, the armature having a tapered conical leading surface facing and substantially parallel to the recessed surface of the pole piece, and a hammer, one end of the hammer being rigidly connected to the armature to form a unitized armature/hammer element for striking a print element in the printer, the hammer extending through the aperture in the pole piece. According to the improved design, the recessed surface of the pole piece and the leading surface of the armature are tapered at an angle of approximately 30° rather than the 40° taught by Veale. This permits the achievement of a significantly longer stroke. The larger diameter end of the recessed surface of the pole piece has a chamfer which is tapered at an angle of approximately 45°. This increases the starting attractive force on the armature.

A cushion made from a resilient material is positioned in the path of the armature for absorbing the momentum of the armature/hammer element when the element rebounds after impact with the print element. According to the present invention, the cushion is reduced in thickness and a magnet is positioned adjacent the side of the cushion opposite to the side thereof which is contacted by the armature for creating a preload on the armature/hammer element. A bearing mounted within the aperture in the pole piece with the hammer extending through the bearing improves bearing concentricity and minimizes wear of moving parts. One end of the hammer is externally threaded and the armature has an internally threaded central aperture for connection of the hammer to the armature thereby improving ram/armature concentricity. The armature has a tapered conical surface at the internal end of the threaded aperture which is tapered at an angle of approximately 45° which eases the armature reluctance, having the effect of increasing the impact energy.

The hammer assembly includes a body which houses the hammer, the hammer extending through an opening in one end of the body. According to the present invention, the opening in the body is generally rectangular in shape and at least the front portion of the hammer has a corresponding rectangular shape, the front portion of the hammer extending through the opening in the body so as to prevent rotation of the hammer relative to the body. The body is made in only two pieces which are connected together by a single pair of screws. A ground spring is incorporated into the body so as to automatically ground the assembly frame upon mounting of the hammer assembly.

OBJECTS, FEATURES, AND ADVANTAGES

It is, therefore, the object of the present invention to solve the problems encountered heretofore in prior art impact printer hammer assemblies. It is a feature of the present invention to solve these problems by the incorporation of a new design of such hammer assembly. An advantage to be derived is a hammer assembly having a sufficient stroke. Another advantage is a hammer assembly having a minimum hammer settling time. Still another advantage is a hammer assembly which minimizes hammer rebound. Still another advantage is a hammer assembly having a consistent impact force. Still another advantage is a hammer assembly having an increased life expectancy. Still another advantage is a hammer assembly in which rotation of the hammer is prevented. Another advantage is a hammer assembly which has a significantly reduced cost. Another advantage is a hammer assembly which has a significantly reduced weight. Still another advantage is a hammer assembly having significantly fewer parts.

Still other objects, features, and attendant advantages of the present invention will become apparent to those skilled in the art from a reading of the following detailed description of the preferred embodiment constructed in accordance therewith, taken in conjunction with the accompanying drawings wherein like numerals designate like or corresponding parts in the several figures and wherein:

DETAILED DESCRIPTION OF THE DRAWINGS

FIG. 1 is a perspective view of a hammer assembly for a high speed impact printer constructed in accordance with the teachings of the present invention; and FIG. 2 is a longitudinal sectional view taken along the line 2—2 in FIG. 1.

DESCRIPTION OF THE PREFERRED EMBODIMENT

Referring now to the drawings, the present solenoid-type hammer assembly, generally designated 10, comprises first and second body members 11 and 12 which are typically made of a hard plastic material. Body members 11 and 12 are connected together by a single pair of screws 13. Positioned between body members 11 and 12 is a generally rectangular, iron frame 14 enclosing a solenoid coil 15 which is wound on a plastic spool 16. As shown most clearly in FIG. 2, spool 16 includes a central cylindrical sleeve 17 and a pair of radically outwardly extending flanges 18, solenoid coil 15 being wound on sleeve 17, between flanges 18. Frame 14 completely surrounds spool 16 and coil 15.

Body member 11 is a composite structure including a hollow, substantially tubular section 21 having an end wall 22 at one end thereof and being open at the other end thereof. Made integral with section 21 is a pair of lateral flanges 23, each having an aperture 24 for accommodating screws 25 for fastening assembly 10 to a frame member or support (not shown) in a printer (not shown). Made integral with the open end of section 21 is a generally U-shaped section 26 which extends across one end of flange 18 of spool 16 and the adjacent end of frame 14. Section 26 follows the contour of frame 14 so as to partially extend along the opposite sides thereof. Section 26 is made with continuous upper and lower lips 27 and 28 which extend across the upper and lower surfaces of frame 14, respectively. It can therefore be seen that frame 14 is securely positioned by section 26 of body member 11.

Body member 12 has a generally similar construction including a hollow, substantially tubular section 31 having an end wall 32 at one end thereof and being open at the other end thereof. Body member 12 also includes a section 36 which is the mirror image of section 26 so as to surround the opposite end and adjacent sides of frame 14. It will, therefore, be apparent to those skilled in the art that the interconnection of body members 11 and 12 by screws 13 establishes the relationship between body members 11 and 12 and frame 14.

Section 26 of body member 11 has at least one aperture 29 therein. The first end of a spring 33 has a hole therein through which a screw 25 extends, the other end thereof extending through an aperture 29 in body member 11 so as to engage frame 14. Spring 33 provides a conductive path from frame 14 to screw 25 so that attachment of hammer assembly 10 to a frame member or support in the printer automatically grounds hammer assembly 10.

Coil 15 surrounds a generally tubular pole piece 40 of pure low-reluctance iron. Pole piece 40 has a central axial bore 41 and a central axial counterbore 42 at one end thereof into which a small bearing 43 is pressed. At the other end of pole piece 40 is a conically-shaped recessed surface 48 which is tapered at an angle of approximately 30°. The larger end of recessed surface 48 has a chamfer 44 which is tapered at an angle of approximately 45°. Pole piece 40 extends into sleeve 17 of spool 16 and also through a hole 45 in frame 14. A flange 46 at the one end of pole piece 40 engages frame 14, surrounding hole 45, thereby fixing the longitudinal position of pole piece 40 relative to frame 14. As seen most clearly in FIG. 2, an internal shoulder 47 in section 26 of body member 11 receives flange 46 whereby to locate body member 11, frame 14 and pole piece 40 relative to each other.

Hammer assembly 10 includes a hammer or ram, generally designated 50, which is a one-piece, multiple-function element. Hammer 50 includes an integral armature-connecting element 51, typically a hard anodized aluminum cylinder, one end of which has a reduced diameter section 52 which is externally threaded, for reasons which will appear more fully hereinafter. Element 51 extends through bearing 43 and is supported thereby for axial movement. The other end of element 51 is made integral with one side of a cylindrical spring locator 53. Spring locator 53 has a tapered portion 54 and a peripheral flange 55. Flange 55 provides a seat for one end of a cylindrical hammer return spring 56, with tapered section 54 assisting in directing spring 56 to flange 55. Spring 56 extends through the tubular section 21 of body member 11 and the other end thereof engages end wall 22. End wall 22 has made integral therewith a cylindrical sleeve 57 having a tapered outside surface for positioning spring 56, the other end of spring 56 surrounding sleeve 57.

Also made integral with hammer 50 and extending from the other side of spring locator 53 is an elongate, generally rectangular, striker 58. Striker 58 extends through a corresponding, generally rectangular, aperture or striker guide 59 in sleeve 57 and end wall 22 whereby striker 58 is prevented from rotating relative to body member 11. Striker 58 is typically of hard anodized aluminum for impacting against a printing element (not shown).

The external threads on section 52 of hammer 50 engage a central, internally-threaded bore 61 in the front of an armature 60 which is of pure, low-reluctance iron. The rear of armature 60 is in the form of an open-ended tube having an interior surface 62. The end of surface 62 adjacent bore 61 is tapered, at 63, at an angle of 45°. The other end 64 of surface 62 has a generally hexagonal cross-section so as to receive a conventional Allen-type socket wrench which will enable armature 60 to be securely attached to section 52 of hammer 50. Fastened in this manner, armature 60 and hammer 50 form a unitized armature/hammer element so that any movement of armature 60 is directly imparted to hammer 50 and striker 58 thereof.

Armature 60 has a leading surface 66 which is tapered at an angle of approximately 30° to form a truncated right frusticonical section. Surface 66 is therefore facing and substantially parallel to recessed surface 48 in pole piece 40. This configuration of surfaces 66 and 48 allows the lines of magnetic force set up between pole piece 40 and armature 60 when coil 15 is energized to be essentially parallel to one another. With the lines of magnetic force being parallel, the strength of the magnetic force between armature 60 and pole piece 40 will remain substantially constant as armature 60 is pulled toward pole piece 40 by the magnetic attraction. This constant force, in turn, results in a constant acceleration being imparted to armature 60, which acceleration, of course, is transmitted directly to striker 58.

To facilitate the axial movement of armature 60, it is journaled in a tubular bushing 68 which extends through a hole 69 in frame 14 and into sleeve 17 of spool 16, one end of bushing 68 engaging the adjacent end of pole piece 40. Bushing 68 may be of polyphenyline sulfide resin.

To absorb the energy of the unitized armature/hammer element as it rebounds after impact with the print element, a polyurethane cushion 70 is fitted into section 31 of body member 12. Cushion 70 is covered by a plastic washer 71. Positioned between cushion 70 and end wall 32 of body member 12 is a thin, rare earth magnet 72 which is cemented to end wall 32. Magnet 72 produces an attractive force on armature 60 and creates a preload of approximately 10 grams on armature 60 through cushion 70.

The general operation of hammer assembly 10 is similar to that described in U.S. Pat. No. 4,239,401 to Veale. Hammer assembly 10 is located adjacent a print wheel or daisy wheel having a plurality of petal-like print elements, each bearing a print character (not shown). With hammer 50 in its withdrawn position, as shown in FIG. 2, striker 58 is spaced a short distance from the daisy wheel so that the daisy wheel may be freely rotated to place the desired element in position in front of striker 58. Striker 58 is in the form of a narrow vertical bar of rectangular cross section because the printing elements are very narrow and spaced very close together.

When coil 15 is energized, a magnetic field is set up between pole piece 40 and armature 60. Armature 60 is propelled toward pole piece 40 with a constant acceleration, as previously described. As armature 60 is pulled toward pole piece 40 by the magnetic field, striker 58 is likewise pulled toward the print element. Striker 58 pulls spring locator 53 forward along with it, thereby compressing hammer return spring 56. The dimensions of armature 60 and pole piece 40 and the spacing between striker 58 and the print element are such that striker 58 strikes the print element before armature leading surface 66 comes into contact with pole piece surface 48.

The striking of a print element by striker 58 drives the print element against a ribbon (not shown) situated in front of a sheet of paper (not shown) to be printed, pressing the ribbon and paper against a platen (not shown), thereby printing a character on the paper. After striker 58 strikes the print element, hammer return spring 56 acting against flange 55 of spring locator 53 pulls hammer 50 back into its withdrawn position. The rebounding armature 60 strikes cushion 70 which absorbs a significant portion of the energy of the armature/hammer unit.

The present invention incorporates a number of improvements over the hammer assembly of Veale so as to achieve a significant improvement in operation, at a substantially reduced cost. Changing the taper of surfaces 48 and 66 from approximately 40° to approximately 30° results in a longer stroke for hammer 50 to insure that armature 60 will not engage pole piece 40 even if a print element breaks and striker 58 must extend all the way to the platen.

The 45° taper 44 at the end of recessed surface 48 increases the starting attractive force on armature 60 and increases the acceleration of armature 60 towards pole piece 40. This increased acceleration increases the impact energy of striker 58 on the print element, as well as increasing the speed of hammer assembly 10.

The addition of magnet 72 between cushion 70 and end wall 32 of body member 12 significantly shortens the settling time, whereby the combination of cushion 70 and magnet 72 absorbs substantially all of the energy of the armature/hammer unit so as to bring the motion of this unit to an almost immediate stop. Magnet 72 further functions to cut drastically the first dangerous rebound of armature 60 which, in the past, could cause striker 58 to engage a print element during rotation of the daisy wheel.

The hammer assembly of Veale included a front bearing secured to the body with three screws. With the present design, the front bearing and the screws are totally eliminated in place of bearing 43 which is pressed into pole piece 40. This improves and simplifies the design, further resulting in an improvement in bearing concentricity.

The armature/hammer element of Veale was a multiple piece arrangement in which the armature was connected to the rod by a tapered engagement, with the armature secured with one screw. The spring locator was pressed on the ram. The tapered engagement of the ram with the armature did not provide good concentricity of the two parts and the two piece ram/striker is expensive to make. Pressing the spring locator on the ram and securing it with a set screw is also expensive. With the present design, hammer 50 and spring locator 53 are a unitary structure and hammer 50 is provided with an integral externally threaded section 52 which engages the internally threaded bore 61 in armature 60, thereby providing good concentricity of the two parts and eliminating the connecting screw.

The tapered interior surface end 63 of surface 62 of armature 60 has the effect of easing the reluctance of armature 60 and the thick tip 80 of armature 60 prevents saturation, increasing the impact energy of striker 58 on the print element.

The hammer assembly of Veale includes a return spring having tangs on each end which mate with tang holes in the spring locator and front bearing. This is not only expensive to manufacture and assemble, but the spring tang and tang holes are not effective in preventing rotation of the striker due to tang hole wear and tang breakage. With the present design, all tangs and corresponding holes are eliminated. The front bearing in body member 11 is replaced by a rectangular aperture 59 which functions as a guide to prevent the rotation of striker 58.

The hammer assembly of Veale included forty-eight parts, thirteen of which were screws which were necessary to assemble the various body parts together. With the present design, hammer assembly 10 includes only a pair of body members 11 and 12 which are held together by a single pair of screws 13. This drastically reduces the parts count and the assembly time, significantly decreasing the overall cost of hammer assembly 10.

Finally, the hammer assembly of Veale contained no provision for a ground system and a separate ground wire was required. With the present design, spring 33 connected between mounting screw 25 and frame 14 functions to automatically ground frame 14 when hammer assembly 10 is mounted on a suitable support member.

While the invention has been described with respect to the preferred physical embodiment constructed in accordance therewith, it will be apparent to those skilled in the art that various modifications and improvements may be made without departing from the scope and spirit of the invention. Accordingly, it is to be understood that the invention is not to be limited by the specific illustrative embodiment, but only by the scope of the appended claims.

I claim:

1. In a hammer assembly for a high speed impact printer of the type comprising a solenoid including a coil and an axially-apertured pole piece, said pole piece having a conically-shaped recessed surface, an axially movable armature within said solenoid, said armature having a tapered conical leading surface facing and substantially parallel to said recessed surface of said pole piece, and hammer means, one end of said hammer means being rigidly connected to said armature to form a unitized armature/hammer element for striking a print element in said printer, said hammer means extending through said aperture in said pole piece, the improvement wherein the larger diameter end of said recessed surface of said pole piece has a chamfer which faces said leading surface of said armature and is tapered at an acute angle relative to the axis of said pole piece which is greater than the angle of taper of said recessed surface of said pole piece and said leading surface of said armature.

2. In a hammer assembly according to claim 1, the improvement wherein said chamfer is tapered at an angle of approximately 45° relative to the axis of said pole piece.

3. In a hammer assembly according to claim 1, the improvement wherein said recessed surface of said pole piece and said leading surface of said armature are tapered at an angle of approximately 30° relative to the axis of said pole piece.

* * * * *